United States Patent [19]

Koudelka

[11] 4,221,170

[45] Sep. 9, 1980

[54] MONORAIL MOUNTAIN SLIDE

[76] Inventor: Slavos Koudelka, East Ridge Rd., Warwick, N.Y. 10990

[21] Appl. No.: 910,469

[22] Filed: May 30, 1978

Related U.S. Application Data

[63] Continuation-in-part of Ser. No. 788,129, Apr. 18, 1977, abandoned.

[51] Int. Cl.[2] ..... A63G 21/04; B61B 13/04; E01B 25/08

[52] U.S. Cl. ..... 104/63; 104/59; 104/69; 104/120; 104/125; 105/145; 188/8; 248/169; 248/171

[58] Field of Search ..... 104/53, 59, 63, 64, 104/69, 118, 119, 120, 125, 126, 134, 245, 246; 105/141, 144, 145; 188/5, 8; 248/169, 171, 653, 656; 280/11, 12 AB; 272/56.5 R, 56.5 SS

[56] References Cited

U.S. PATENT DOCUMENTS

| | | | |
|---|---|---|---|
| 1,808,497 | 6/1931 | Dina | 248/653 |
| 1,819,886 | 8/1931 | Frank et al. | 104/119 X |
| 1,852,384 | 4/1932 | Wallin | 104/69 |
| 3,520,514 | 7/1970 | Evans | 104/126 X |
| 3,826,196 | 7/1974 | Wallace | 104/126 |
| 3,973,785 | 8/1976 | Becker et al. | 188/8 X |

FOREIGN PATENT DOCUMENTS

| | | | |
|---|---|---|---|
| 922107 | 1/1955 | Fed. Rep. of Germany | 104/119 |
| 1119318 | 12/1961 | Fed. Rep. of Germany | 105/141 |
| 448779 | 2/1913 | France | 104/119 |
| 39754 | 3/1932 | France | 104/118 |

*Primary Examiner*—Randolph A. Reese

*Attorney, Agent, or Firm*—Le Blanc, Nolan, Shur & Nies

[57] ABSTRACT

A monorail mountain coaster for recreational transportation along an inclined path on a hill or mountain comprising a channel disposed on and spaced from the path, a chassis frame moveable along the channel, a coaster shell resiliently mounted on the chassis frame, riding wheels rotatably mounted on the chassis frame and engaged with the channel for movement of the frame along the channel, retainer wheels rotatably mounted to the frame disposed about and engaged with the channel to retain the frame on the channel and a brake pivotally mounted to the frame and engageable with the channel to stop the movement of the frame on the channel. The channel is suspended above the inclined path on, for example, the side of a hill, by suspension brackets which securely prevent the channel from moving. The frame with pivotally mounted shell is then allowed to roll along the channel on its wheels and provide entertaining and recreational transportation along the path. The brackets and channel are easily removeable to change the location of the slide run.

7 Claims, 6 Drawing Figures

MONORAIL MOUNTAIN SLIDE

This is a continuation-in-part application of the inventor's formally filed application with Ser. No. 788,129 filed Apr. 18, 1977, now abandoned.

BACKGROUND OF THE INVENTION

1. Field of the Invention

This invention relates in general to slides for transporting people or things along a predetermined path and in particular to a new and useful monorail mountain slide which provides an easily adaptable and removeable course on which a frame with a shell can ride to form a toboggan or slide run.

2. Description of the Prior Art

Toboggan or slide runs, commonly known as "Alpine Slides", have been provided which utilize a concave, concrete or asbestos path in which rides a car or shell provided with wheels for movement within the concave surface of the path. The path is usually disposed along a declining surface so that the car or toboggan can roll down a path and provide the transport for recreational or other purposes.

Disadvantages of the prior toboggan run include the fact that any increased speed often causes an oscillation of the car within the path and can possibly lead to the car leaving the path. Even if the car does not leave the path, the violent oscillations may lead to injury, especially of the occupants' hands, if they are holding the edges of the car. To counteract these problems, additional safety measures must be provided, such as safety rails along the path, to prevent injury of the occupants.

Other disadvantages of the prior art toboggan runs are that the concave surface often accumulates debris which must be removed for safety purposes before a toboggan run can be made.

In addition, excessive excavation is often needed to provide a sufficiently gradual turn in the concrete path so as to prevent abrupt changes of direction in the motion of the toboggan which cannot be sufficiently compensated for by the concave surfaces of the path. Additional excavation is also needed to provide the proper foundation for the concrete path required to prevent frost damage as in any concrete structure. Furthermore an additional disadvantage is the fact that the concrete path is of a permanent nature and one installed cannot be readily removed without damage to the path.

SUMMARY OF THE INVENTION

The present invention provides a toboggan run or slide which effectively avoids the difficulties of the prior art slides. In the invention a channel with flanges is provided along a predetermined path. The channel is supported at intervals by support members which are connected to the underside of the channels and angled downwardly toward the earth. The members are provided in pairs which angle downwardly from the channel to produce a 90° overall support to each other and are disposed parallel to the next pair of support members along the channel and perpendicularly to the major axis of the channel in a straight section. Along a curved section of the run the supports are placed in a manner for best structural strength in view of the forces to be exerted on the run. This construction forms a rigid support for the channel to prevent any motion thereof as a toboggan or coaster slide car moves along it.

A multiplicity of channels are fastened together as will be described hereinafter, to form a monorail track. The monorail track on which the coaster rolls is formed of a plurality of straight and curved channels each having a side flange preferably extending upwardly. Advantageous dimensions for the channels have been found to be 9" wide with a flange of 2½" and a length of 20'. Such construction if made of steel has been found to be approximately 260 lbs. in weight and therefore relatively easily portable in view of the prior art structures.

Each channel section includes a plurality of plates welded to the bottom thereof and extending downwardly therefrom. Preferrably a single plate is welded adjacent each end of the channel and a pair of plates are welded near the center. A leg or support can be inserted between each pair of plates near the center of each channel where it is bolted at the desired angle. The junction between two adjacent channels with their connected plates forms a joint between which a pair of legs can be bolted. The bolting of the pair of legs between the spaced plates serves to fasten adjacent channels sections together and further additional bolts can be used through the plates to further secure the connection between adjacent channels.

Channel sections can be provided in either straight lengths or curved lengths to define a toboggan run of any desired shape. Three preferable types of channel sections have been found, one being the straight section, another being a 15 degree curved section of a 34 foot radius and a 30 degree section of a 34 foot radius. The curved sections are bent about the radius and are further advantageously shaped to provide a proper banking for any turn in the toboggan run. Curved and straight channel sections can be connected together to form turns of 7½, 15, 30, 45, 90, 120, 180 and 360 degree curves.

The track is supported above the desired path on the side of the mountain or hill by pairs of legs which are connected between the track and the path surface. Each leg comprises an outer tube with an inner tube slideable therein which can be set at a desired length and locked in position at a required adjustment to thereby level the track properly.

As previously mentioned a single pair of legs is connected at the junction between abutting channels to support one end of each channel. Other pairs of legs are connected at the mid-point of longer channels or deleted where not necessary so that on the average a preferable spacing between leg pairs has been found to be approximately 10 feet.

A separate leg assembly is employed for supporting curved channel sections of the track which assembly utilizes a turnbuckle adjustment to firmly secure the track to the designated path. The leg assembly utilizes one leg which is connected to the plates extending substantially perpendicularly to the path and another leg which extends at an angle to the path and outwardly from the outside of a curve in the track. A turnbuckle connected between each plate and the outside leg can be adjusted advantageously to exactly define the banking of each curved section.

The base of each leg is connected to two angle brackets bolted on either side of each leg. Each angle bracket in turn has a plurality of holes so that the base of each bracket can be spiked to the ground with suitable means. It has been found that once the channel sections are bolted together not all of the angle brackets need be spiked to the ground to secure a proper and rigid positioning of the track.

The installation of the monorail track is conveniently accomplished in a reversible manner so that the track can be removed from a designated path when desired as for example to clear the way for winter activities.

The channel sections can be laid out along the designated path after it is cleared and the legs can be preassembled and attached at their designated space locations along the track wing. A grade or incline of between 5 and 40 percent can be accommodated by the monorail track. However, a preferable range for the grade lies intermediate of these two extreme perimeters. The provision of an incline therefore in the range of around 20 degrees has been found to be most preferable in that it provides for a more enjoyable ride.

No special or costly treatment in preparing the ground for installation of the track is required. The monorail rests on its legs which are supported by the angle pieces and the only requirement for ground preparation is that a path from 6 to 10 feet across be cleared. After the monorail track is removed from the path, no permanent damage remains on the ground and the impact therefore on the environment is minimal.

Further by providing a raised monorail with only spaced legs, the continuous winding concrete run of a standard toboggan apparatus is avoided. Such a continuous run normally served to divide the side of the mountain in a physical manner thus upsetting the normal path of animals, the run off of water and in general the ecological system of the mountain.

Further, in removing the monorail track from the path, the track can be positioned as a whole adjacent the path thus permitting a quick and easy reassembly of the monorail track when it is to be reinstalled.

In combination a coaster is utilized in conjunction with the track which comprises a strong molded high density polyethylene body. The plastic body is connected resiliently to a steel undercarriage or chassis. The connections between the body and the chassis can be for example hard rubber mounts similar to that utilized in engine mountings to advantageously cushion the ride of a rider in the coaster.

The chassis or chassis frame is provided with four riding wheels, two front wheels and two rear wheels, which ride on the top of the channel. Additionally, four retaining wheels are mounted with vertical axis to the chassis which bear against the flanged sides of the channel sections. The retaining wheels are mounted on either side of the channel and securely retain the coaster on the channel from any lateral motion.

Four lower wheels are provided for abutment against the bottom surface of the channel to prevent the coasters from leaving the channel in a vertical direction. These retaining wheels and lower wheels also prevent the coaster from tipping from side to side. The provision of the three sets of four wheels therefore serves to resiliently but positively engage the coaster to the channel which engagement still provides an easy rolling of the coaster down the channel regardless of the lateral or vertical forces on the coaster due to its serpentine path down the track.

Each coaster is provided with a braking system which provides an efficient and positive braking for the coaster on the track. The brake assembly includes a hand lever which is pivotally mounted to the chassis frame and which operates the two front wheels and the brake pads. The brake assembly also includes a front set of brake pads which serve as drag brakes to slow the coaster to a gradual stop when the hand lever is in the vertical position and a set of rear brake pads which can be engaged with a channel surface to stop the coaster from its forward motion.

Each coaster is therefore preferably provided with two sets of brake pads which are associated with the two front riding wheels of the device. The front riding wheels are mounted to a bracket which includes the brake pads. The front brake pads serve as drag brakes which slow the coaster to a gradual stop with the hand lever in the neutral position. Except on the steeper portions of the track, the coaster will coast to a stop if the passenger does nothing or lets go of the lever. When the lever is pushed forward the coaster is lifted off the drag brakes and onto the front wheels which, in conjunction with the rear wheels, allows the coaster to accelerate. Pulling back the hand lever brings the coaster back through the neutral position resting on the drag portion of the brake pads and the rear wheels, into the more positive braking position where the two sets of brake pads are pressed down fully against the track. If the lever is pulled all the way to the rear, the coaster is virtually lifted off its wheels and the upper portion of the track, resting only on the two sets of brake pads.

Therefore, in summary, for the coaster to roll on the track a user must actuate the lever forward to urge the riding wheels against the track and thus lift the brake pads off the track. For a braking action, a user may pull the lever back to lift the forward riding wheels off the track and to urge the brake pads against the track. For an emergency stop situation the lever can be pulled back to such an extent so that the entire coaster is lifted off the track and supported only on its two sets of braking pads. A rider thus has a better control, a more positive braking action and a sense of involvement or full control of the speed of the coaster down the toboggan track and the coaster has an inherent safety feature in that if the lever is released for any reason the coaster will naturally cruise to a halt. As an extra safety, the coaster is provided with quality auto type seat belts.

Comfortable speeds for the coaster down the track have been found to be between fifteen and twenty miles per hour. The rider's ability to quickly bring the coaster to a stop on any portion of the track enhances the enjoyability of the ride and the security of the rider.

Further as distinguished from the prior art toboggan runs, there is no possibility for a rider to come in contact with the track since the track is completely separated from the rider's position on the coaster, and this precludes the possibility of cuts, burns or abrasions which are commonly inflicted on prior art toboggan runs.

For the curved section of the track, a unique mounting structure is provided for increasing the stability of the track on curves and further for facilitating the easy height adjustment and removability of the curved sections of the track. In the area of a curved section, two legs can be connected to an outside pair of holes in the support plates of the track, one extending perpendicularly to the ground and the other extending at an angle and directed toward the outside of the curve. An inside hole of the support plate is connected to the outside leg through an adjustable turnbuckle.

Each leg which comprises a telescoping member within a cylinder member, is provided with an adjustable clamping collar which can be released to increase or decrease the overall length of the leg. That is to adjust the height of the curved section of track, the clamping collar of the outside leg is released and the overall length of the outside leg is increased which rotates the entire track assembly with its support plate about the perpendicularly disposed leg. The outside leg clamping collar is then secured and the clamping collar of the perpendicularly disposed leg is released. The perpendicularly disposed leg is then increased in its overall length and the turnbuckle is adjusted to accomodate the changes in the lengths of the two legs. The overall effect of the aforementioned adjustment is to increase the height of the curved section of track above the ground to its desired level. The inventive support in the curved section also provides for a rigid support of the track in its curved section to resist the extra forces exerted on the track when a coaster rounds the curved section of track.

Concerning the monorail's resistance to weather, the apparatus is virtually unaffected by the elements. While the system should not be operated in rainy conditions, the track is easily and quickly dried after a rain or morning dew to resume normal service. As a result, little time is lost after a rainfall in getting the coaster back in operation. Problems involved with clearing a normal toboggan run which involves the sliding of a coaster, is also avoided in that the coaster rides on wheels.

The monorail run can also quickly be secured from any unauthorized use by locking a bar or chain through or around the track in the beginning and end sections of the monorail run. Further a counter in the form of a limit switch can also be provided to monitor use and for ticket sale.

A main object of the present invention, therefore is to provide a monorail mountain slide or toboggan run which utilizes a monorail construction including rigidly connected easily assembled and disassembled channel and support members and a coaster shell resiliently mounted on a chassis frame engaged to the channel for movement of the coaster along the channel by a plurality of retainer wheels.

A further object of the present invention is to provide a monorail mountain toboggan or slide run including a toboggan car or slide car comprising a frame having roller means engageable with the monorail or channel and retaining means disposable beneath a portion of the channel to retain the frame on the channel.

A still further object of the invention is to provide a toboggan or channel slide run in combination with a mountain coaster having a braking system controlled in a positive manner to effectively reduce the speed or stop the coaster or toboggan on the channel.

Another object of the invention is to provide a slide which is portable, simple in design, rugged in construction and economical to manufacture.

Still a further object of this invention is to be able to present a more versatile slide having a monorail mountain path which path can be changed, assembled or disassembled as desired.

The various features of novelty which characterize the invention are pointed out with particularity in the claims annexed to and forming a part of this disclosure. For a better understanding of the invention, its operating advantages and specific objects attained by its use, reference should be made to the accompanying drawings and descriptive matter in which there are illustrated preferred embodiments of the invention.

DESCRIPTION OF THE PREFERRED EMBODIMENTS

Figure 1:
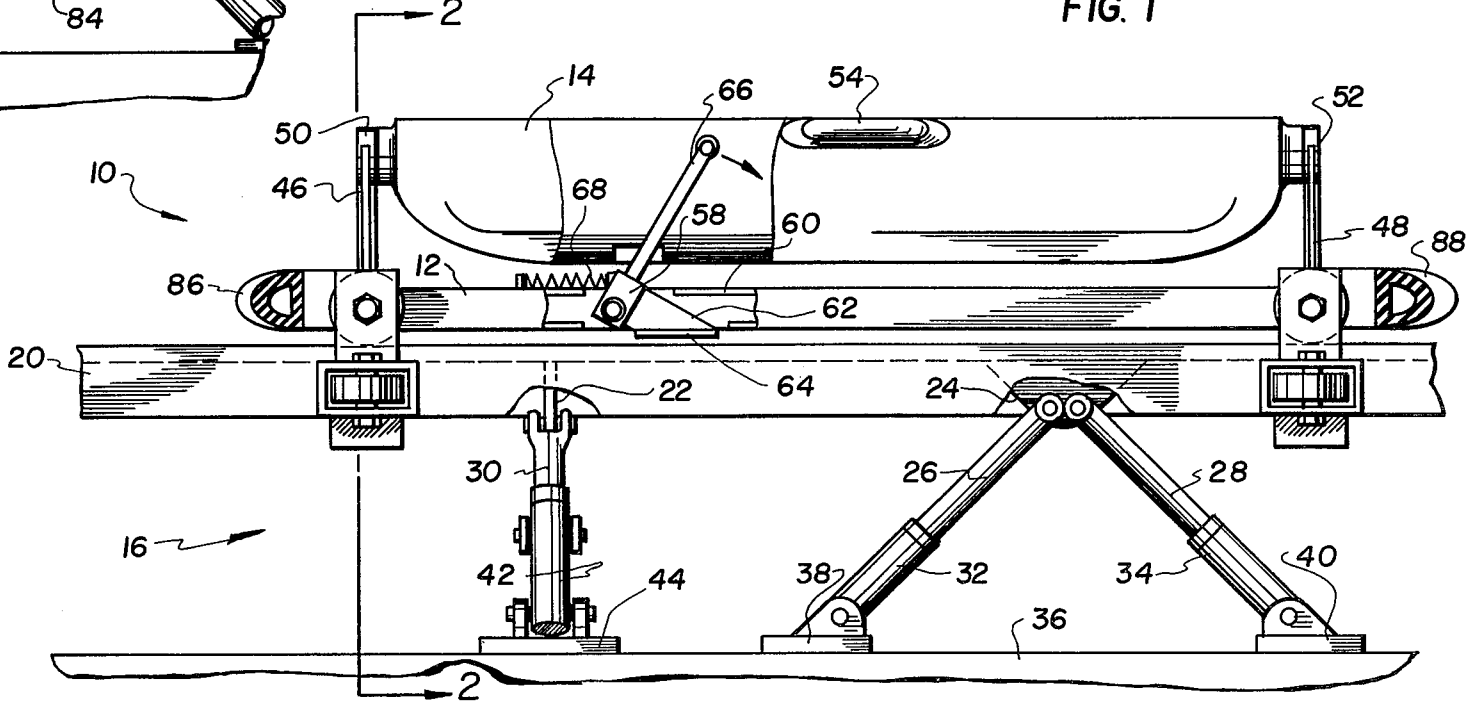
FIG. 1 is a side elevational view with portions cut away, showing one embodiment of the invention.

Referring to the drawing in particular, the invention embodied therein, as shown in FIG. 1, is a monorail mountain slide comprising a coaster generally designated 10 which rides along a monorail track generally designated 16. Monorail 16 includes a channel 20 which can be laid along a predetermined path on, for example, the side of a mountain or hill. At space locations along the undersurface of channel 20 are downwardly extending support members 22 and 24 which are alternately disposed at 90 degrees to each other along the channel 20. In a curved section of the monorail the 90 degree angle changes depending on the curve.

Figure 2:
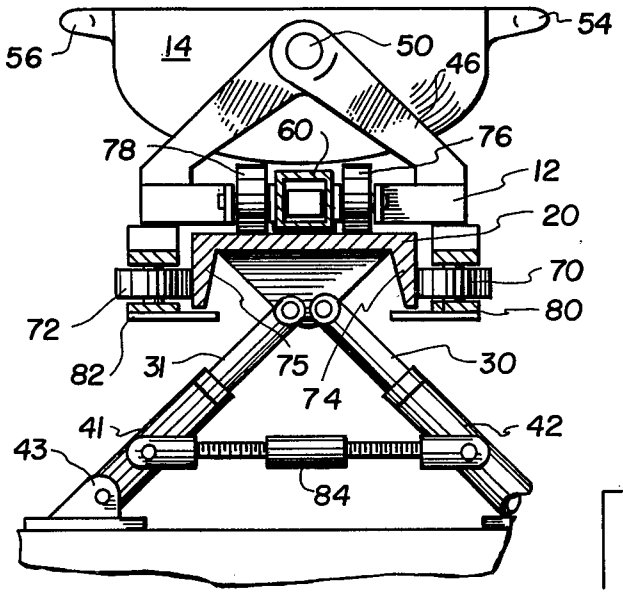
FIG. 2 is a front elevational view, partially in section, taken along lines 2—2 of FIG. 1.

Connected to support members 22 and 24 are respective angles support arms 26, 28, and 30. Supported arms 26 and 28 are threaded into lower support arms 32 and 34 respectively to provide the required distance between the channel 20 and ground 36. Lower support arms 32 and 34 are connected to respective anchor members 38 and 40 which are removably fixed to the ground 36. Support arm 30 is similarly threaded into lower support arm 42 which is anchored into anchor member 44. Companion support arms and anchor 31, 41 and 43 are best seen in FIG. 2.

Provided for motion along channel 20 is the coaster 10 which comprises a slide or toboggan frame 12 which carries shell support arms 46 and 48. A shell 14 is pivotally mounted about pivots 50 and 52 to the shell support arms 46 and 48 respectively. The shell 14 is provided with lateral handles 54 and 56 which can be grasped by an occupant of the shell 14 or can be used to move the slide.

A braking arm 58 is pivotally mounted to a central portion 60 of frame 12. Extending from braking arm 58 is an angled plate 62 which is in turn connected to a brake pad 64 which is engageable with the top surface of the channel 20. A handle 66 is provided so that an occupant of the shell 14 may manually pivot the braking arm 58 on the frame 60 and press the braking pad 64 against the upper surface of the channel 20 in order to slow or stop the motion of the coaster 10.

Return spring 68 is provided between the braking arm 58 and the frame 60 to retain the braking arm 58 in the upward position so that the pad 64 is normally spaced from the upper surface of the channel 20. It should be noted that an extra safety feature of the invention is that the braking arm 58 extends through a slot of the shell 14, as shown in FIG. 1, thereby acting as a stop preventing extreme oscillation of the coaster.

As best seen in FIG. 2, side rollers 70 and 72 extend downwardly from frame 12 and are rotatably connected thereto and engageable with side flanges 74 and 75 of the channel 20. Top rollers 76 and 78 are rotatably mounted to central portion 60 of the frame 12 and roll along the top surface of the channel 20. This roller assembly is repeated at the rear end of the frame 60 and provides a stable rolling support for the shell 14. Retaining members 80 and 82 are connected to the lower portion of frame 12 below the side rollers 70 and 72 and extend inwardly under the flange portions 74 and 75 of channel 20. These retaining members effectively retain the frame 12 on the channel 20 when the coaster 10 is riding along the channel.

Connected between the lower support arms 41 and 42 is an adjustable turn buckle 84 which can be adjusted to provide the angle between the support arms 41 and 42 on their respective anchors.

As best seen in FIG. 1, the front and back portions of frame 12 are provided with bumpers 86 and 88 to prevent any damage to the frame 12 when another coaster may be contacted in front or back of the coaster.

Referring now to the embodiment shown in FIGS. 3 to 6, a monorail mountain slide comprises a coaster 101 made of a high density polyethylene plastic or fiberglass construction. The coaster is molded in one piece and includes a seat portion 102 and leg and foot rest portions 103. Coaster 101 is resiliently mounted to a frame generally designated 105 through resilient hard rubber mountings 107. The monorail mountain slide also comprises a monorail track 110 composed of a plurality of straight and curved channel sections 111 which are connected end to end.

Frame 105 is also provided with forward riding wheels 115 and rear riding wheels 117 so that coaster 101 can ride along track 110. Track 110 is supported on a predetermined path 120 which is defined for example on the side of a mountain. Track 110 is supported by assemblies generally designated 125.

Figure 4:
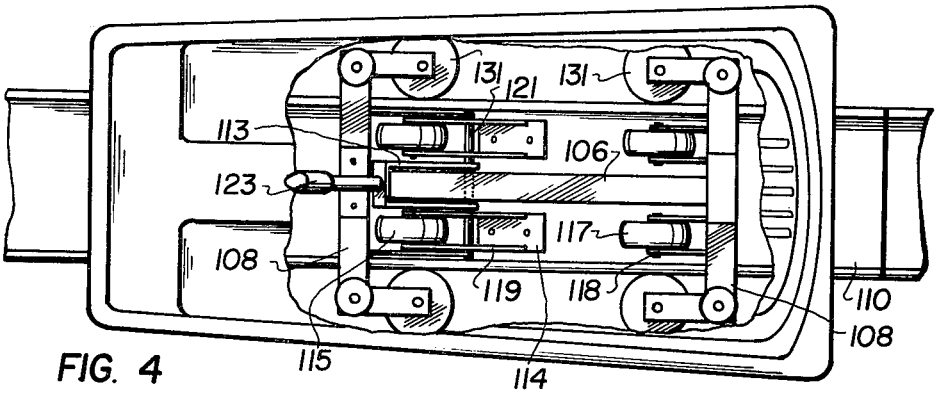
FIG. 4 is a top plan view with portions cut away, of the embodiment shown in FIG. 3.

Frame 105 includes a longitudinal member 106 and two transverse members 108 connected to the ends of the longitudinal member 106, as best shown in FIG. 4. Rear riding wheels 117 are rotatably mounted to brackets 118 which are in turn secured to the rear transverse member 108.

The forward riding wheels 115 are rotatably mounted to pivotal brackets 119 which are secured to a shaft 121 which is pivotally mounted within the longitudinal member 106.

Furthermore, the mountain slide includes a brake system comprising two sets of brake pads; a set of forward brake pads 112 which serve as drag brakes and a set of rear brake pads 114 which are located near the geometric center of the frame 105 and are secured to an end of the pivotal brackets 119 opposite the forward riding wheels 115.

A lever bracket 113 is secured for example by welding to the shaft 121. A lever or hand brake arm 123 is connected to the lever bracket 113 and may be actuated in a forward or reverse direction by a rider.

Figure 3:
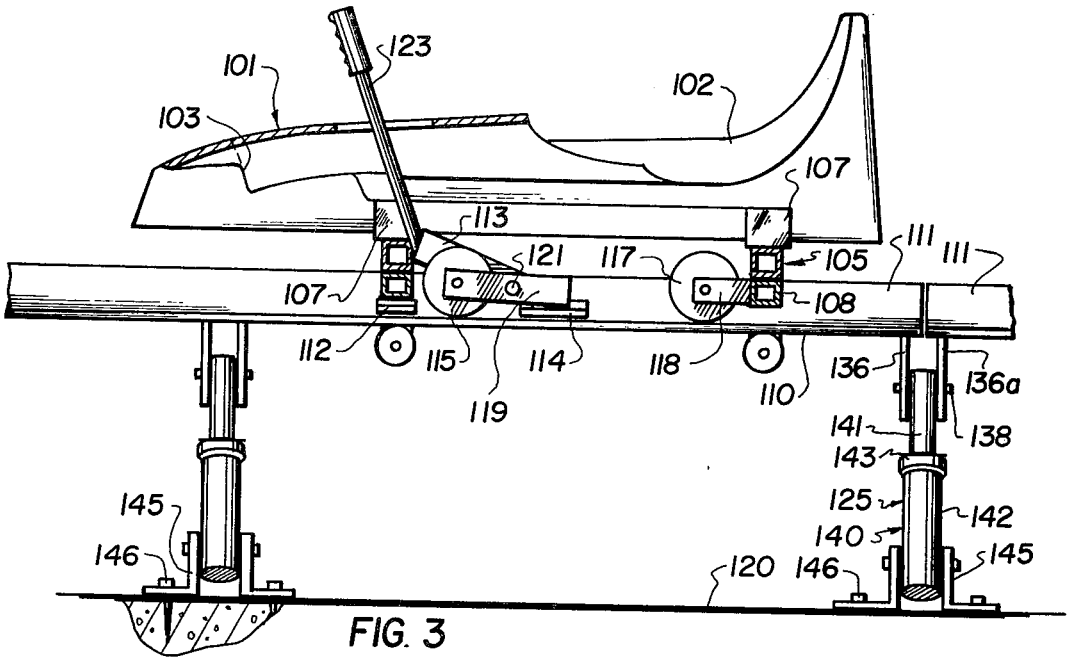
FIG. 3 is a side elevational sectional view of another embodiment of the invention.

As shown in FIG. 3, frame 105 is provided with the forward drag brake pads 112 which are secured to the forward transverse member 108. When the lever 123 is unactuated in the neutral position, forward brake pads 112 normally contact the track 110 and the weight of coaster 101 is partially supported on pads 114. In this position coaster 101 remains stationary on the track 110.

In operation when a rider wishes to commence the rolling of the coaster 101 on the track 110, he pushes the lever 123 in the forward direction which rotates shaft 121 in the counter clockwise direction as seen from FIG. 3, which urges the forward riding wheels 115 down against the track 110. Simultaneously with this, the forward and rear brake pads 112 and 114 are lifted off the track 110 and the rolling of the coaster on riding wheels 115 and 117 commences.

To stop the coaster 101 a rider pulls back on the lever 123 thus permitting brake pads 112 and 114 to re-engage with track 110 to slow the forward progress of the coaster 101.

For an emergency or faster stop, a rider may pull back more energetically on the lever 123 to virtually lift the entire coaster 101 off its wheels 115 and 117 and be supported exclusively on the brake pads 112 and 114.

Figure 5:
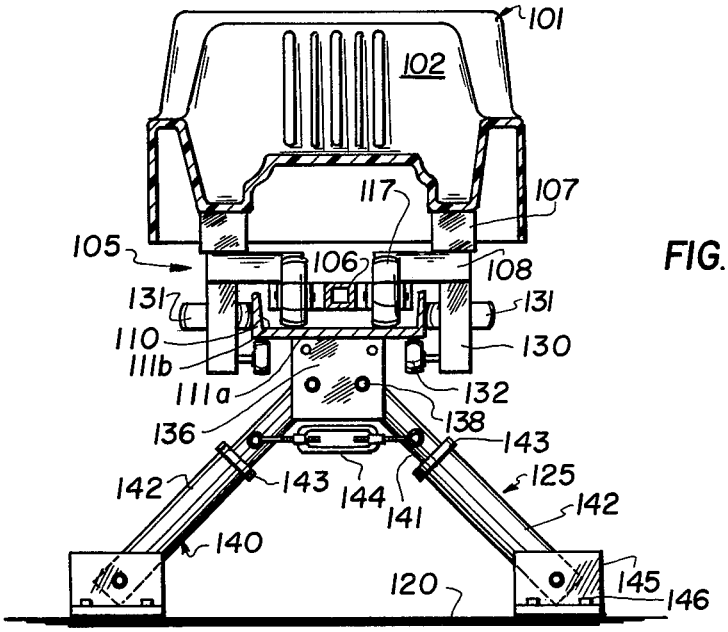
FIG. 5 is a front sectional view of the embodiment shown in FIG. 3; and, FIG. 6 is a front sectional view of the embodiment shown in FIG. 3 on a curved section of track.

Referring now to FIG. 5, it is seen that retaining wheels 131 are also provided for retaining the coaster 101 on to the track 110. Channel sections 111 include bottom portions **111*a* and side flange portions 111*b*. Side retaining wheels 131 are therefore rotatably mounted to side members 130 of frame 105 and bear against side flanges 111*b* of sections 111. These side retaining wheels 131 prevent the lateral displacement of the coaster 101**.

As best shown in FIGS. 3 and 5 coaster 101 is prevented from leaving track 110 in a vertical direction by bottom retaining wheels 132 which are also rotatably mounted to side members 130.

As best shown in FIG. 5, supporting leg assemblies 125 support track 110 on the path 120. The assemblies comprise legs 140 which include telescopic sections 141 and cylinder sections 142. Legs 140 can be adjusted to any desired length by loosening clamping collars 143 to release telescopic sections 141 which can then be slid in respect to cylinder sections 142 to the desired length. Clamping collars 143 are then rotated to secure legs 140 at a predetermined length to lift or lower the track 110 at a desired elevation from the path 120.

Each channel section 111 is provided with a plurality of support plates 136 which extend downwardly from the track 110. Two relatively closely spaced support plates 136 can be provided near the center of each channel section 111 and a telescopic section 141 of a leg 140 may be bolted to the two spaced support plates 136.

As shown at the right side of FIG. 3, each section 111 may also be provided with respective end support plates 136 which can be combined with end plates **136*a* of an adjacent section 111 to support a leg 140 utilizing a through bolt 138**.

As best seen in FIG. 5, legs 140 are preferrably disposed at 90 degrees to each other on straight sections of track 110. Each leg 140 is bolted to a pair of angled support feet 145 which may in turn, as best seen in FIG. 3 be spiked or otherwise secured to the path 120 with spikes 146. A turnbuckle 144 is provided between legs 140 and tightened to better secure and position the track 110 with respect to the path 120.

Figure 6:
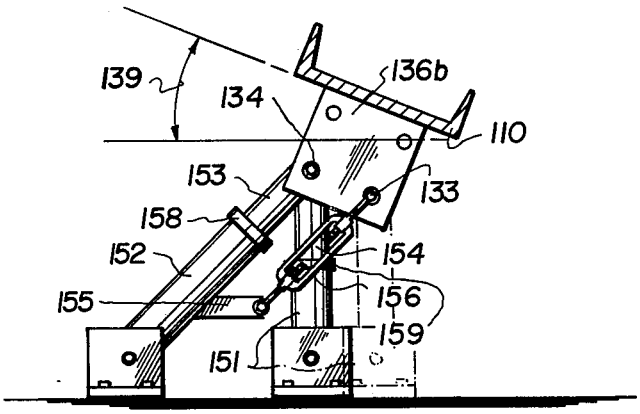

As seen in FIG. 6, for supporting a curved section 111 of track 110 in a banked or inclined position, a support arrangement can be utilized. A first leg 151 is shown substantially perpendicularly disposed to the path 120. First leg 151 is secured through outside bolts 134 to the plate **136*b***.

Also connected to outside bolt 134 is a second angled outside leg 152. Telescopic sections 153 and 154 of legs 152 and 151 respectively may be of a suitable shape so as to both fit between the plates **136*b* and be bolted to the outside bolt 134**.

An angle bracket 155 is rigidly secured onto leg 152 as for example by welding and is connected to a turnbuckle 156. Turnbuckle 156 is in turn connected to an inside bolt 133 of the plate **136*b*. This arrangement permits for the easy and convenient changing of the banking angle 139 for the track 110 on a curved section and also for the similarly easy and quick adjustment of the height of the track 110 over the path 120** in the curved section.

To adjust or increase the height of the track 110 over the path 120 in a curved section as shown in FIG. 6, one first loosens bolts 134 and 133 respectively sufficiently to permit a rotation about these points. Secondly collar 158 of leg 152 is loosened and telescopic section 153 is pulled out of leg 152 for a predetermined distance. As leg 151 remains unchanged in length, the track 110 then is moved to the right of FIG. 6 and the normally vertically disposed leg 151 is then positioned at an angle to the track 120. After this operation clamping collar 158 is rotated to lock leg 152 at its new length.

After locking collar 158 collar 159 of leg 151 is loosened and telescopic section 154 is slid out of leg 151 by rotative turnbuckle 156 for a distance so that leg 151 is in a vertical position. That is turnbuckle is rotated so that leg 151 will be substantially perpendicular with the path 120. Collar 159 is then again locked and the track would be raised at a desired elevation. Alternatively, the leg 151 may be positioned as shown in phantom in FIG. 6.

The lowering of track 110 can be provided by reversing the aforementioned operation. During the aforementioned operations, turnbuckle 156 can be adjusted to accomodate the changes of lengths of legs 151 and 152 respectively. It should also be noted that turnbuckle 156 provides for a rigid support against pressures exerted by the coaster 101 when it rounds the track 110 in the curved section.

While specific embodiments of the invention have been shown and described in detail to illustrate the application of the principles of the invention, it will be understood that the invention may be embodied otherwise without departing from such principles.

What is claimed is:

1. A monorail mountain slide including a mountain coaster and a monorail for recreational transportation along an inclined path on a hill, comprising: a monorail channel track disposed along and spaced from the path said channel having a bottom portion and side portions; a chassis frame movable along said channel and comprising a central elongate longitudinal support member and front and rear transverse support members at the respective ends of the longitudinal member and extending beyond the respective said sides of said channel; a coaster shell resiliently mounted on said chassis frame; first roller means mounted on said rear transverse support member engaging said channel bottom portion; a bracket pivotally mounted on said longitudinal member rearwardly of said front transverse support member; second roller means mounted to one end of said bracket and arranged to selectively engage said channel bottom portion; first brake means mounted to an end of said bracket opposite said one end and positioned to selectively engage said channel bottom portion; drag brake means affixed to the bottom of said front transverse support member; lever actuating means mounted on said bracket and movable from a first normal, neutral rest position, wherein both said first brake means and said drag brake means are engaged with said channel bottom portion, to a second position, wherein said first brake means are forcefully engaged with said channel bottom portion, and to a third position wherein both said brake means are disengaged from said channel bottom portion and said second roller means are engaged therewith so that said chassis frame and coaster may move along said track; and retaining means depending from the respective ends of both said transverse support members, said retaining means being engaged with said channel to restrain lateral and vertical movement of said chassis frame with respect to said track.

2. A monorail mountain slide according to claim 1 wherein said track sides comprise vertically extended flanges and said retaining means include side wheels horizontally rotatably mounted to said transverse support member ends and are engageable with said flanges of said track to thereby restrain the coaster on the track from lateral motion.

3. A monorail mountain slide according to claim 1 wherein said retaining means further include lower wheels vertically rotatably mounted to said transverse support member ends and abut against an under surface of the channel to thereby prevent the coaster from leaving the track in a vertical direction.

4. A monorail mountain slide according to claim 1 wherein said channel further includes support members connected between said channel and the predetermined path, said support members comprising pairs of angled support arms connected between said channel and the path.

5. A monorail mountain slide according to claim 1 further including a leg assembly connected between said channel and the path comprising a plurality of pairs of support plates connected to the underside of said channel, a pair of legs extending at an angle from each other from each of said pairs of support plates, each of said legs comprising a cylindrical section and a telescopic section slideable within said cylindrical section, a pair of angled support feet connected to each cylindrical section and anchorable to the path, and a turnbuckle connected between telescopic sections of said leg pair.

6. A monorail mountain slide according to claim 1 further including a leg assembly connected between a banked portion of said channel and the path, said leg assembly comprising a plurality of pairs of support plates extending from the underside of said channel, a pair of legs connected to each of said pairs of support plates at a common point thereon, each of said legs comprising an outer cylindrical section and and inner telescopic section slideable within said outer cylindrical section, anchoring means connected between said cylindrical sections and the path for anchoring said channel to the path, and at least one turnbuckle connected between one of said cylindrical sections and said support plate at a location spaced from the connection between said support legs and said pairs of support plates.

7. A monorail mountain slide according to claim 1 further including a leg assembly connected between a curved portion of said channel and the path, said leg assembly comprising a plurality of support plates connected to the underside of said channel, at least one leg connected between said support plate and extending at an acute angle toward the outside of the curve, said at least one leg being anchorable to the path, a turnbuckle connected between said leg and said support plate, said connection between said turnbuckle and and support plate being spaced from the connection between said leg and said support leg, and at least one additional leg connected between said support leg and the path.

* * * * *